United States Patent [19]

Wagaman et al.

[11] Patent Number: 4,907,980

[45] Date of Patent: Mar. 13, 1990

[54] PRESSURE COMPENSATING CONNECTOR ASSEMBLY

[75] Inventors: James P. Wagaman, Chatsworth; Gordon A. Porter, Agoura, both of Calif.

[73] Assignee: Kintec, Inc., Chatsworth, Calif.

[21] Appl. No.: 380,160

[22] Filed: Jul. 14, 1989

Related U.S. Application Data

[63] Continuation of Ser. No. 265,426, Oct. 31, 1988.

[51] Int. Cl.[4] ..... H01R 13/523

[52] U.S. Cl. ..... 439/204; 439/199; 439/206; 439/271

[58] Field of Search ..... 439/199, 201, 204, 206, 439/271, 275, 276

[56] References Cited

U.S. PATENT DOCUMENTS

| | | | |
|---|---|---|---|
| 3,633,155 | 1/1972 | Taylor | 439/204 |
| 4,373,767 | 2/1983 | Cairns | 439/199 X |
| 4,500,155 | 2/1985 | Chevalier | 439/275 |
| 4,606,603 | 8/1986 | Cairns | 439/206 X |

*Primary Examiner*—Steven C. Bishop

*Attorney, Agent, or Firm*—Nilsson, Robbins, Dalgarn, Berliner, Carson & Wurst

[57] ABSTRACT

A connector for use in deep ocean environments has a housing defining an interior chamber filled with non-electrically conducting fluid wherein the cable termination is interconnected to a male or female contact apparatus. A pressure equalizing apparatus according to the invention includes a pair of mating sleeves positioned in the interior chamber, in spaced apart relationships, each having a cylindrical mating surface which sealingly mates against the interior surface of the chamber and a projecting sleeve receiving cylindrical surface. The sleeve receiving surfaces are juxtaposed opposite one another. An elastomeric boot is positioned over the sleeve receiving surfaces of each mating sleeve to thereby extend between the pair of sleeves and divide the interior chamber into an interior non-electrically conducting fluid retaining region and an exterior region. An orifice is provided through the connector housing to provide communication between the exterior region adjacent the elastomeric boot and the environment outside the connector.

6 Claims, 1 Drawing Sheet

PRESSURE COMPENSATING CONNECTOR ASSEMBLY

BACKGROUND OF THE INVENTION

The present invention relates to undersea connectors and specifically to apparatus for equalizing the pressure between an interior chamber of the connector and the outside environment in which the connector is placed.

The inaccessibility and expense of changing or repairing deep ocean electrical connectors has mandated that such connectors be extremely reliable even though operating in a hostile deep ocean salt water environment with cathodic corrosive effects and extreme pressures.

Connectors used in deep ocean environments often include an interior closed chamber filled with non-conductive fluid wherein connection of individual wires in a cable are made either to a male or female connector insert. The connector end of the insert extends from the interior chamber of the connector assembly and is available for connection to a cooperating connector assembly. It is recognized that if the pressure in the interior chamber fluid is equalized with the pressure of the environment in which the connector is placed, the chances of failure of the connector due to pressure differentials will be greatly reduced.

Heretofore, various mechanisms have been used to achieve such pressure equalization. For example, in some connectors the interior chamber is pre-pressurized to a pressure which approximates the pressure of the environment in which the connector will actually be used. However, large pressure differentials will still exist when the connector is not: in its operating environment such as before installation. Plungers and various other complex mechanical mechanisms have also been used to enable pressure of the interior chamber to be continuously varied to match the external pressure of the environment. However, the complexity and expense of such mechanisms have limited their applicability to only the largest connector assemblies and even then only where the added expense could be justified. Consequently pressure equalization mechanisms for small sized, deep ocean connectors or less expensive connectors have not heretofore been possible.

The present invention solves this problem by providing a pressure compensation mechanism for use particularly in deep sea connector assemblies which allow the interior chamber of the connector to always be at the same pressure as the external environment while still maintaining the integrity of the non-electrically conducting fluid in the interior of the chamber.

SUMMARY OF THE INVENTION

A pressure compensation apparatus for a connector assembly which defines in its interior a chamber in which a substantially incompressible, non-electrically conducting fluid resides, includes a first cylindrical mating sleeve positioned in the chamber where the first mating sleeve has a first surface which is configured to be in sealing contact against the circumferential interior surface of the chamber. The first mating sleeve further includes a second surface which is spaced radially inwardly from the circumferential surface of the chamber for providing a space between the second surface and the circumferential surface of the chamber The second surface has on its remote end a first circumferential locator nib which protrudes radially toward the circumferential surface of the chamber but remains spaced from that surface.

A second cylindrical mating sleeve is similarly positioned in the connector chamber but in spaced relationship to the first mating sleeve. The second mating sleeve likewise has a third surface which, like the first surface on the first mating sleeve, provides a sealing contact against the interior surface of the chamber. The second mating sleeve also has a fourth surface which is spaced inwardly from the circumferential surface of the chamber thereby providing a space between the fourth surface and the circumferential interior surface of the chamber. The fourth surface also has a locator nib which protrudes radially therefrom in a direction toward the circumferential surface of the chamber but is radially spaced therefrom. An elastomeric boot is positioned to extend between the first and second mating sleeves whereby the elastomeric boot has a first end sized for being stretch fitted over the second surface of the first mating sleeve and having a second end which is sized to be stretched fitted over the fourth surface of the second mating sleeve thereby bifurcating the chamber into an interior region inside the boot and an exterior region radially between the boot and the surface of the chamber. The exterior region extends longitudinally between the first surface of the first mating sleeve and the third surface of the second mating sleeve. The housing is then provided with a pressure equalizing orifice therethrough at a location whereby the exterior region of the chamber communicates with the environment outside the connector so that the incompressible fluid confined in the interior region of the chamber will be at the same pressure as the environment outside the connector.

BRIEF DESCRIPTION OF THE DRAWINGS

These and other advantages and features of the invention will be more fully apparent from the detailed description below taken with the accompanying drawings in which like reference characters refer to like parts throughout and wherein.

DETAILED DESCRIPTION

Figures 1, 2:
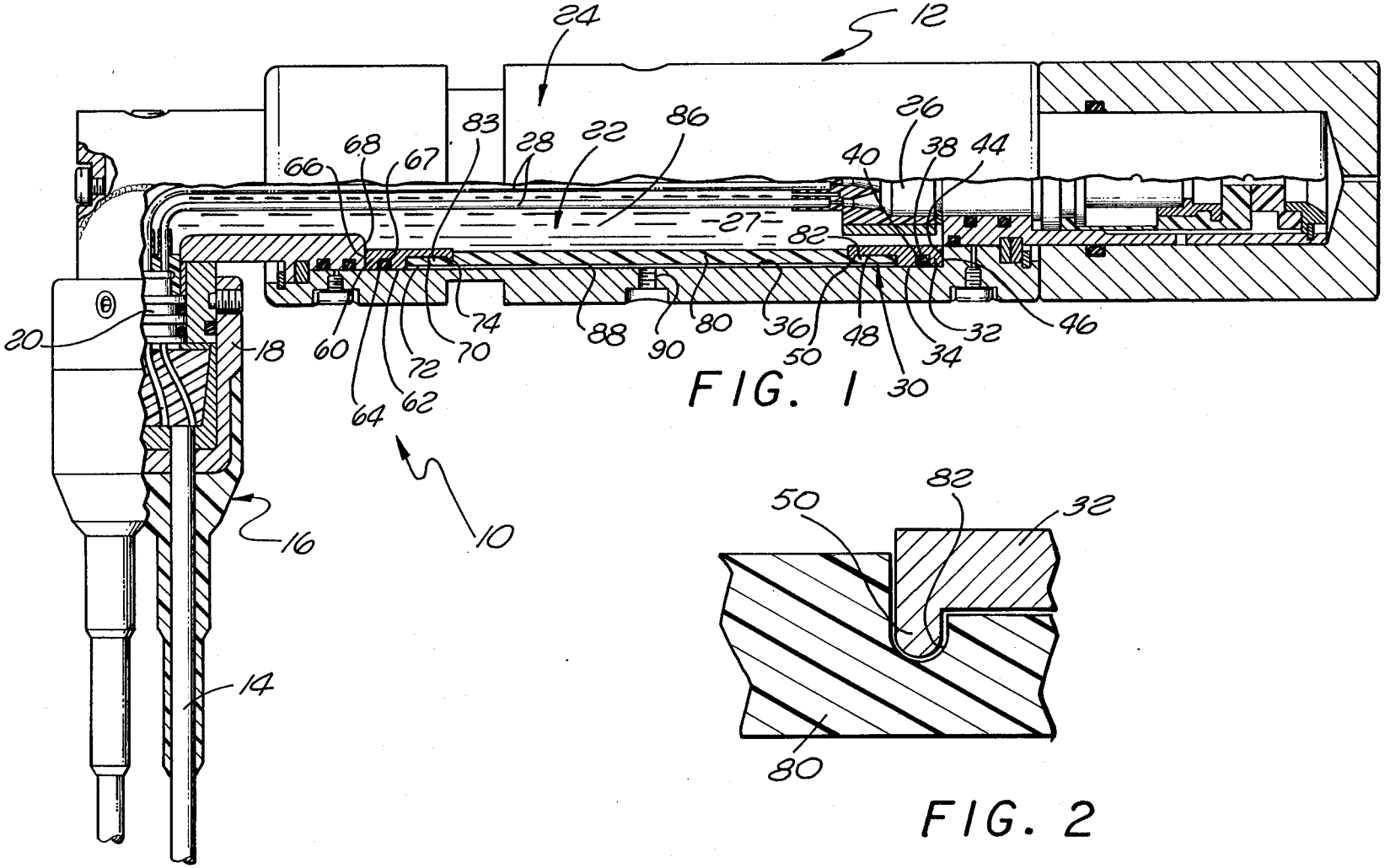
FIG. 1 is a partial cut-away side view of a connector assembly which incorporates a pressure equalizing apparatus in accordance with the invention.
FIG. 2 is a detail illustrating the right locator nib positioned in a circumferential channel in the elastomeric boot in accordance with the invention.

Referring to FIG. 1, a connector assembly 10, defined by a coupling member 12 includes a cable 14 which extends through a boot 16 to a shell 18 where the individual wires of the cable 14 feed through an insert 20 into an interior chamber 22 of the coupling member 12. The chamber 22 is defined by the interior region of A housing 24 which generally includes several parts joined together with pins, split rings and other appropriate section mating mechanisms well known in the art. The chamber 22 is a closed chamber being closed circumventially by the housing 24, being closed on one end by the feed through insert 20 and on the other end opposite the one end by a contact insert 26 which may either be a female or male insert.

When connectors with interior chambers, such as the one depicted in FIG. 1, are used in undersea environments, the pressure differential can adversely affect the sealing necessary to maintain maximum integrity of the coupling member 12 and, in particular, to prevent contamination of the insulating oil 27 which is placed in the chamber 22. Any salt water invasion or contamination in the chamber 22 could result in corrosion of critical electrical components and could cause electrical conduction between individual wires 28 which extend through the chamber 22.

Therefore, in accordance with the invention, a pressure compensation apparatus 30 has been incorporated in the chamber 22. The pressure compensation apparatus 30, in the illustrated embodiment of the invention, includes a first mating sleeve 32, which is preferably cylindrical, with a first mating surface 34 in sealing contact against the juxtapositioned interior cylindrical surface 36 of the chamber 22. To enhance sealing between the surface 34 and the surface 36, an 0 ring 38 is placed in a circumferential groove 40 in the first surface 34 of the first mating sleeve 32. In the preferred embodiment of the invention, longitudinal positioning is maintained by providing a circumferential radially disposed abutting surface 44 in the housing. A radially projecting surface 46 of the first mating sleeve 32 is provided to abut against the radial surface 44 in the interior of the housing 24. Axial movement of the first mating sleeve is thereby made impossible.

The first mating sleeve 32 further includes a second surface 48 which is spaced radially inwardly from the surface 36 of the chamber 22 thereby providing a space between the second surface 48 and the chamber interior surface 36. In accordance with a preferred embodiment of the invention, the second surface has a circumferential locator nib 50 which protrudes radially from the surface 48 toward, but still spaced from, the surface 36 of the chamber 22.

In accordance with the invention, a second cylindrical mating sleeve 60 is similarly positioned in the chamber 22 but at a location spaced from the first mating sleeve 32. Like the first mating sleeve 32, the second mating sleeve 60 has an axially extending circumferential surface 62 which is in sealing contact against a juxtapositioned portion of the surface 36 of the chamber 22. An appropriate 0 ring 64 is placed in a circumferential groove 67 to ensure that a seal is made and maintained between the surface 62 and the surface 36. Like the first mating sleeve, the second mating sleeve 60 also has a radially projecting abutment surface 66, perpendicular to the surface 62, for abutment against a radially projecting interior housing surface 68. The abutment between the surfaces 66 and 68 ensures that axial movement of the second mating sleeve 60 will be impossible.

The second mating sleeve 60 further includes a sealing surface 70 which is spaced inwardly from the circumferential surface of the chamber 22 to thereby provide a space 72 between the surface 70 and the surface 36. In a preferred embodiment of the invention, the sealing surface 70 has a circumferential locator nib 74 which protrudes radially from the surface 70 but which is still spaced from the surface 36 of the chamber 22.

The locator nib 50 of first mating sleeve 32 preferably positioned at the end of the surface 48 remote from the abutting surface 46. Likewise the locator nib 74 of mating sleeve 60 is located at the end of the mating sleeve 60 remote from the abutting surface 66.

An elastomeric boot 80 is provided with a first end 82 sized for being stretched fitted over the sealing surface 48 between the first mating sleeve and the interior surface 36 of the chamber 22. The elastomeric boot 80 further has a second end 83 which is sized to stretch fit over the second mating sleeve 60 between the surface 70 of the mating sleeve 60 and the interior surface 36 of the chamber 22.

Referring to FIG. 2, in a preferred embodiment, the boot 80 has an interior disposed circumferential channel 82 which is positioned adjacent to boot 80 but inwardly spaced from each end, one being at a location adapted, for example, to receive the locator nib 50 thereby enabling the boot 80 to be properly positioned over the first and second mating sleeves 32 and 60 respectively. Accordingly, a seal is formed between the surface 48 and the first end 82 of the boot 80 and between the surface 70 and the other end 83 of the boot 80. The boot 80 thereby divides the chamber 22 into an interior cylindrical region 86 and an exterior cylindrically-shaped region 88 with the non-conductive fluid 26 confined by the boot 80 in the interior region 86.

In order to provide pressure compensation, an orifice 90 is provided through the housing 24 in communication between the exterior environment of the connector and the exterior region 88 of the chamber 22. Since the fluid 26 in the portion 86 in the chamber 22 is incompressible, the orifice 90 will permit equalizing pressure communication via the boot 80 so that the pressure in the interior portion 86 of the chamber 22 will be the same as the pressure in the exterior region of the portion 88 of the chamber 22. Such pressure equalization enables the connector in accordance with the present invention to eliminate pressure as a cause which would urge fluid from the outside of the interior chamber 22 to communicate with the fluids interior to the connector.

In the preferred embodiment, in order to provide a superior seal between the boot 80 and the first and second mating sleeves 32 and 60, respectively, the boot 80 is molded over the surfaces 48 and 70 prior to insertion in the chamber 22. the direct molding of the boot onto the mating sleeves provides a superior seal and eliminates the need to preform the channels, such as channel 82 depicted in FIG. 2.

While a specific embodiment of the invention has been described in connection with FIGS. 1 and 2, those skilled in the art will appreciate that many modifications and variations of the invention are possible without departing from the invention in its broadest aspects.

What is claimed is:

1. A pressure compensation apparatus for a connector assembly with at least one coupling member comprising a housing with a cable receiving end having a cable receiving orifice therethrough, an interface end with an insert member therein configured to mate with another coupling member, and first means positioned in the cable receiving orifice whereby the cable, comprising at least one wire, extends through the first means, the housing defining a circumferential chamber with a circumferential surface extending between the first means and the insert member, the cable extending through the chamber to couple to the insert member, the chamber having disposed therein a substantially incompressible non-electrically conducting fluid, the pressure compensation apparatus for equalizing the pressure between the inside of the chamber and the outside environment while preventing fluid communication between the chamber and the outside environment comprising:

a first cylindrical mating sleeve positioned in the chamber and having a first surface for sealing contact against the circumferential surface of the chamber and a second surface spaced inwardly from the circumferential surface of the chamber for providing a space between the second surface and the circumferential surface of the chamber;

a second cylindrical mating sleeve positioned in the chamber in spaced relationship to the first mating sleeve, the second mating sleeve having a third surface for sealing contact against the circumferential surface of the chamber and a fourth surface spaced inwardly from the circumferential surface of the chamber for providing a space between the fourth surface and the circumferential surface of the chamber;

an elastomeric boot having a first end mounted on the second surface of the first mating sleeve and having a second end mounted on the fourth surface of the second mating sleeve to thereby bifurcate the chamber into an interior region inside the boot and an exterior region radially between the boot and the surface of the chamber and longitudinally between the first surface and the third surface;

the housing having a pressure equalizing orifice therethrough at a location whereby the exterior region of the chamber communicates with the environment outside the connector, the incompressible fluid being confined to the interior region of the chamber.

2. The pressure compensation apparatus of claim 1 wherein the second surface of the first mating sleeve has a first circumferential nib protruding radially therefrom toward the circumferential surface of the chamber; the fourth surface of the second mating sleeve has a second circumferential nib protruding radially therefrom toward the circumferential surface of the chamber; and the elastomeric boot defines an interior surface with a first circumferential channel therein adjacent to but spaced from the first end and a second circumferential channel therein adjacent to but spaced from the second end, the first channel configured for receiving the first nib and the second channel configured for receiving the second nib.

3. The pressure compensation apparatus of claim 1 wherein the first and second ends of the elastomeric boot are sized for being stretch fitted over the second surface of the second mating sleeve and the fourth surface of the second mating sleeve respectively, whereby the first and second ends of the boot are mounted on the first and second mating sleeves.

4. The pressure compensation apparatus of claim 2 wherein the first and second ends of the elastomeric boot are sized for being stretch fitted over the second surface of the second mating sleeve and the fourth surface of the second mating sleeve respectively, whereby the first and second ends of the boot are mounted on the first and second mating sleeves.

5. The pressure compensation apparatus of claim 1 wherein the elastomeric boot is a molded boot, directly molded onto the first and second mating sleeves.

6. The pressure compensation apparatus of claim 2 wherein the elastomeric boot is a molded boot, directly molded onto the first and second mating sleeves.

* * * * *